US010774834B2

(12) United States Patent
Wang et al.

(10) Patent No.: US 10,774,834 B2
(45) Date of Patent: Sep. 15, 2020

(54) SPHERICAL COMPRESSOR

(71) Applicant: Shenzhen Zhongke Zheng'an Science & Technology Partnership Enterprise (limited partnership), Shenzhen, Guangdong (CN)

(72) Inventors: Luyi Wang, Shaanxi (CN); Zhengping Li, Shaanxi (CN)

(73) Assignee: Shenzhen Zhongke Zheng'an Science & Technology Partnership Enterprise (limited partnership), Shenzhen (CN)

( * ) Notice: Subject to any disclaimer, the term of this patent is extended or adjusted under 35 U.S.C. 154(b) by 169 days.

(21) Appl. No.: 16/166,098

(22) Filed: Oct. 20, 2018

(65) Prior Publication Data

US 2019/0055944 A1 Feb. 21, 2019

Related U.S. Application Data

(63) Continuation of application No. PCT/CN2017/078509, filed on Mar. 29, 2017.

(30) Foreign Application Priority Data

Apr. 20, 2016 (CN) ..... 2016 2 0333567

(51) Int. Cl.

| | |
|---|---|
| ***F04C 18/48*** | (2006.01) |
| ***F04C 3/06*** | (2006.01) |
| ***F04C 29/00*** | (2006.01) |
| ***F04C 21/00*** | (2006.01) |

(52) U.S. Cl.

CPC ..... *F04C 18/48* (2013.01); *F04C 3/06* (2013.01); *F04C 21/005* (2013.01); *F04C 29/00* (2013.01); *F04C 2240/20* (2013.01); *F04C 2240/80* (2013.01)

(58) Field of Classification Search

CPC .... F04C 18/48; F04C 21/005; F04C 2240/20; F04C 2240/80; F04C 3/06

See application file for complete search history.

(56) References Cited

U.S. PATENT DOCUMENTS 10,316,844 B2 * 6/2019 Wang ..... F04C 18/54

FOREIGN PATENT DOCUMENTS

| | | | |
|---|---|---|---|
| CN | 200971863 | Y | 11/2007 |
| CN | 101929463 | A | 12/2010 |
| CN | 103147991 | A | 6/2013 |
| CN | 103541892 | A | 1/2014 |
| CN | 103835955 | A | 6/2014 |
| CN | 203742997 | U | 7/2014 |

(Continued)

*Primary Examiner* — Mary Davis

(74) *Attorney, Agent, or Firm* — Wayne & Ken, LLC; Tony Hom

(57) ABSTRACT

A spherical compressor is provided. A cylinder body and a cylinder head are combined to form a spherical inner cavity. A sliding chute swinging mechanism is arranged between a piston shaft and a piston shaft hole or between a turntable shaft and a turntable shaft hole. The turntable shaft is driven to rotate so that a piston swings along a sliding chute relative to the axis of the piston shaft hole, or a turntable swings along the sliding chute relative to the axis of the turntable shaft hole, so as to form a V1 working chamber and a V2 working chamber with alternatively variable volumes in the spherical inner cavity.

12 Claims, 12 Drawing Sheets

(56) References Cited

FOREIGN PATENT DOCUMENTS

| | | | |
|---|---|---|---|
| CN | 104314808 | A | 1/2015 |
| CN | 105179197 | A | 12/2015 |
| CN | 105756932 | A | 7/2016 |
| CN | 205559282 | U | 9/2016 |
| DE | 665347 | C | 9/1938 |
| DE | 4325166 | A | 2/1995 |
| GB | 403914 | A | 1/1934 |

* cited by examiner

SPHERICAL COMPRESSOR

CROSS-REFERENCE TO RELATED APPLICATIONS

This application is a continuation of International Patent Application No. PCT/CN2017/078509, filed on Mar. 29, 2017 which claims the benefit of priority from Chinese Application Nos. 201610243847.1 and 201620333567.5, filed on Apr. 20, 2016. The content of the aforementioned applications, including any intervening amendments thereto, are incorporated herein by reference.

TECHNICAL FIELD

The disclosure relates to a spherical compressor.

BACKGROUND

A spherical compressor is a newly invented variable-volume mechanism with a novel structure. The spherical compressor requires no intake/exhaust valve, few moving parts, and has the advantages of small vibration, high mechanical efficiency, reliable sealing performance, etc. There are many patents of spherical compressors, such as Chinese Patent No. 03114505.1 (titled "Variable-volume Mechanism for Compressor"), CN200610104569.8 (titled "Spherical Compressor Capable of Multi-stage Compression"), and CN201010264211.8 (titled "Hinge Sealing Automatic Compensation Mechanism for Spherical Compressor"). The application and development of spherical compressors have made steady progress in recent years. Spherical compressors can be widely used in various fields such as gas compressors, refrigerator and refrigeration air-conditioning compressors and pump machinery. Various power machines based on spherical compressors are undergoing industrialization.

Since the rotation of a piston of an existing spherical compressor is powered by an eccentric main shaft, when the main shaft rotates to the point where the axis of a turntable coincides with the axis of the piston, the resultant force of the main shaft acting on the turntable perpendicularly intersects with the axis of the piston and the axis of the turntable, so that the torque of the piston rotating around the axis of the piston is zero and the piston cannot rotate, thus causing clamping stagnation of the mechanism, which is the dead center of the mechanism. The Chinese Patent No. 201410100390.X titled "Anti-Locking Mechanism for Rotor of Spherical Compressor" aims to solve the problem of locking at a dead center of a spherical compressor. Specifically, a pin boss is added to a turntable shaft; a guide sleeve is arranged on the pin boss; a concave sliding chute is arranged on a base spherical surface of a cylinder body or a lower spherical surface of the cylinder body; and the concave sliding chute is distributed on the sliding track of the guide sleeve on the corresponding base spherical surface of the cylinder body or the lower spherical surface of the cylinder body during the rotation of a turntable. At the moment when the rotating torque of the turntable is zero, when the main shaft drives the turntable, the contact force generated by the guide sleeve and the concave sliding chute can still keep the turntable moving, so that the turntable is not prone to clamping stagnation, fundamentally solving the dead center problem during the movement of the spherical compressor mechanism. However, high precision of the concave sliding chute is required to ensure a good fit between the guide sleeve and the concave sliding chute, and a cooling mechanism is needed to prevent heat generation caused by friction of the guide sleeve and the concave sliding chute during the movement of the anti-locking mechanism, thus increasing manufacturing and operation costs.

SUMMARY

This application is to design a novel spherical compressor based on the existing spherical compressor so that the spherical compressor is a mechanism without dead center.

The spherical compressor includes:

a cylinder body having a hemispherical inner cavity and a turntable shaft hole in communication with an outside of the cylinder body;

a cylinder head having a hemispherical inner cavity; wherein the cylinder head is combined with the cylinder body to form a spherical inner cavity; an intake passage, an exhaust passage and a piston shaft hole are provided on an inner spherical surface of the cylinder head; the intake passage and the exhaust passage on the cylinder head are arranged in an annular space perpendicular to an axis of the piston shaft hole; the intake passage and the exhaust passage communicate with an intake hole and an exhaust hole on the cylinder head in communication with the outside of the cylinder body, respectively;

a piston having a spherical top surface, two side faces which form an angle and a piston pin boss at the lower part of the two side faces; where the spherical top surface of the piston and the spherical inner cavity have the same center and form a sealed loose fit; the piston pin boss is a semi-cylinder; a middle part of the semi-cylinder is provided with a groove; a piston pin hole which penetrates is provided on a central axis of the semi-cylinder; a piston shaft protrudes from a center of the spherical top surface of the piston; and an axis of the piston shaft passes through the center of the spherical top surface of the piston;

a turntable having a turntable pin boss corresponding to the piston pin boss; wherein the turntable pin boss is arranged at an upper part of the turntable; an outer peripheral surface between the upper part and a lower end face of the turntable is a turntable spherical surface; the turntable spherical surface has the same center with the spherical inner cavity and is closely attached to the spherical inner cavity to form a sealed loose fit; two ends of the turntable pin boss are provided with semi-cylindrical grooves; a middle part of the turntable pin boss is provided with a protruding semi-cylinder; a turntable pin hole which penetrates is formed on a central axis of the semi-cylinder; a turntable shaft protrudes from a center of a lower end of the turntable; and the turntable shaft passes through the center of the turntable spherical surface; and a center pin inserted into a pin hole formed by matching the turntable pin boss with the piston pin boss to form a cylindrical hinge; wherein matching surfaces of the cylindrical hinge form a sealed loose fit;

wherein the axis of the piston shaft hole and the axis of the turntable shaft hole both pass through the center of the spherical inner cavity; and an included angle between the axis of the piston shaft hole and the axis of the turntable shaft hole is a; a sliding chute swinging mechanism is arranged between the piston shaft and the piston shaft hole or between the turntable shaft and the turntable shaft hole; the sliding chute swinging mechanism between the piston shaft and the piston shaft hole allows the piston to swing along a sliding chute relative to the axis of the piston shaft hole; and the sliding chute swinging mechanism between the turntable shaft and the turntable shaft hole allows the turntable to swing along the sliding chute relative to the axis of the turntable shaft hole with a swing amplitude of $2\alpha$; the turntable shaft is driven to rotate so that the piston and the turntable relatively swing around the center pin; and a V1 working chamber and a V2 working chamber with alternatively variable volumes are formed between the upper end face of the turntable, the two side faces of the piston and the spherical inner cavity.

Further, a rotary sleeve in a cylindrical shape is arranged in the piston shaft hole on the cylinder head. An outer cylinder of the rotary sleeve is coaxial with the piston shaft hole, and the rotary sleeve can rotate around the axis of the piston shaft hole. A rotary sleeve sliding chute in a direction of an axis of the center pin is arranged on an end face of the rotary sleeve, and two side faces of the rotary sleeve sliding chute are symmetrically arranged on both sides of a plane of the axis of the center pin and the axis of the piston shaft hole. A piston shoe is fixedly arranged at an end of the piston shaft, and the piston shoe is arranged in the rotary sleeve sliding chute. Two side faces of the piston shoe are attached to two side faces of the rotary sleeve sliding chute and slide along the two side faces of the rotary sleeve sliding chute to form a loose fit, and the rotary sleeve sliding chute on the rotary sleeve and the piston shoe on the piston shaft form the sliding chute swinging mechanism. The turntable shaft is inserted into the turntable shaft hole on the cylinder body to form a rotating pair with the cylinder body, and a sealing plug is arranged at an end of the piston shaft hole on the cylinder head.

A piston shaft pin hole is provided at the end of the piston shaft. A piston shoe shaft hole and a piston shoe pin hole matched with the piston shaft pin hole are provided at a center of the piston shoe, and the piston shaft is inserted into the piston shoe shaft hole after passing through a via hole through which the piston shaft hole communicates with the spherical inner cavity. A fixing pin is inserted into a pin hole formed by matching the piston shoe pin hole with the piston shaft pin hole to fix the piston shoe at the end of the piston shaft. The two side faces of the piston shoe are parallel planes, and the two side faces of the piston shoe are attached to the two side faces of the rotary sleeve sliding chute respectively to form a loose fit.

The turntable shaft extends out of the cylinder body and is connected to a power mechanism to serve as a power input end of the compressor.

Further, a lower end of the cylinder body is connected to a main shaft through a main shaft support. An upper end of the main shaft is placed in the turntable shaft hole, and an outer cylinder at the upper end of the main shaft is coaxial with the turntable shaft hole. The main shaft rotates around the turntable shaft hole. A main shaft sliding chute is provided on an upper end face of the main shaft in a direction of an axis of the center pin, and two side faces of the main shaft sliding chute are symmetrically arranged on both sides of a plane of the axis of the turntable shaft hole and the axis of the center pin. A piston shoe is fixedly arranged at the end of the turntable shaft, and the piston shoe is arranged in the main shaft sliding chute. Two side faces of the piston shoe are attached to the two side faces of the main shaft sliding chute and slide along the two side faces of the main shaft sliding chute to form a loose fit, and the main shaft sliding chute on the main shaft and the piston shoe on the turntable shaft form the sliding chute swinging mechanism.

A lower end of the main shaft is connected to a power mechanism.

A turntable shaft pin hole is provided at the end of the turntable shaft. A piston shoe shaft hole and a piston shoe pin hole matched with the turntable shaft pin hole are provided at a center of the piston shoe, and the turntable shaft is inserted into the piston shoe shaft hole after passing through a via hole through which the turntable shaft hole communicates with the spherical inner cavity. A fixing pin is inserted into a pin hole formed by matching the piston shoe pin hole with the turntable shaft pin hole to fix the piston shoe at the end of the turntable shaft. The two side faces of the piston shoe are parallel planes, and the two side faces of the piston shoe are attached to the two side faces of the main shaft sliding chute respectively to form a loose fit.

The piston shaft hole on the cylinder head communicates with the outside of the cylinder body, and the piston shaft extends out of the piston shaft hole and is connected to the power mechanism to serve as the power input end of the compressor.

Further, the piston includes a piston insert. The piston insert is of a fan-shaped block structure with thick sides and a thin middle, and is embedded in the groove in the middle part of the piston pin boss of the piston. The shape of an inner cylindrical surface of the piston insert is matched with the shape of a protruding semi-cylindrical surface of the turntable to form a sealed loose fit. A protruding top surface of the piston insert is an outer cylindrical surface which is matched with a bottom surface of the groove of the piston pin boss of the piston. Two side faces of the piston insert are flush with the two side faces of the piston, and two end faces of the piston insert form a sealed loose fit with two side walls of the groove in the middle part of the piston pin boss.

The present application has the following advantages:

1. the spherical compressor is a mechanism without dead center;
2. the spherical compressor requires a simple structure, a small number of parts and low processing precision;
3. there is no power consumption loss caused by friction and heating when passing through a dead-center mechanism, and there is no need to arrange a special cooling mechanism; and
4. the spherical compressor can be widely used in refrigeration compressors, air conditioning compressors, air compressors and pump machinery.

Figure 1:
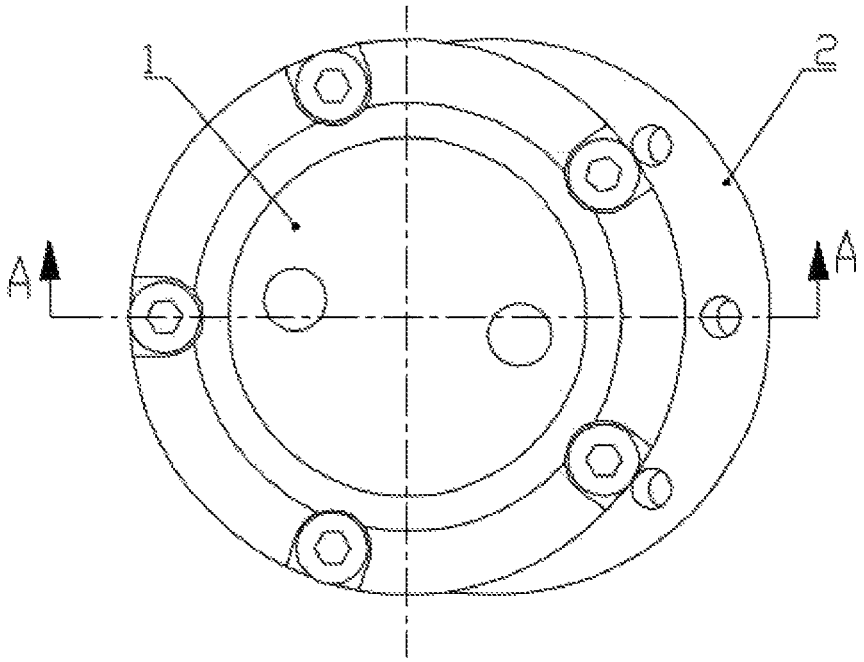
FIG. 1 is a schematic diagram of a first embodiment of the present invention.

Reference numerals: 1—cylinder head; 2—cylinder body; 3—piston; 4—center pin; 5—turntable; 6—rotary sleeve; 7—sealing ring; 8—bearing; 9—piston shaft sleeve; 10—fixing pin; 11—sealing plug; 12—main shaft; 13—main shaft support; 14—piston shoe; 15—needle bearing; 16—sliding chute swinging mechanism;

101—intake hole; 102—exhaust hole; 103—intake passage; 104—exhaust passage; 105—piston shaft hole; 201—turntable shaft hole; 301—piston shaft; 302—piston pin hole; 303—piston shaft pin hole; 304—piston insert; 501—turntable shaft; 502—turntable pin hole; 503—turntable shaft pin hole; 601—rotary sleeve sliding chute; 141—piston shoe shaft hole; 142—piston shoe pin hole; 121—main shaft sliding chute;

1001—V1 working chamber; and 1002—V2 working chamber.

DETAILED DESCRIPTION OF THE

Example 1

FIGS. 1-13 show the illustration of the first embodiment. As shown in FIGS. 1-8, the spherical compressor includes a cylinder head 1, a cylinder body 2, a piston 3, a center pin 4 and a turntable 5. The cylinder body 2 and the cylinder head 1 have hemispherical inner cavities, and the cylinder body 2 and the cylinder head 1 are fixedly connected by screws to form a casing of the spherical compressor with a spherical inner cavity. An intake passage 103, an exhaust passage 104 and a piston shaft hole 105 are provided on the inner spherical surface of the cylinder head 1. The cylinder body 2 is provided with a turntable shaft hole 201 in communication with the outside of the cylinder body. One side of the turntable shaft hole 201 communicates with the spherical inner cavity, and the other side is provided with a bearing seat hole which is coaxial with the turntable shaft hole 201. The axis of the piston shaft hole 105 and the axis of the turntable shaft hole 201 both pass through the center of the spherical inner cavity, and the included angle between the axis of the piston shaft hole 105 and the axis of the turntable shaft hole 201 is a. The intake passage 103 and the exhaust passage 104 on the cylinder head 1 are arranged in an annular space perpendicular to the axis of the piston shaft hole 105 on the inner spherical surface. An intake hole 101 and an exhaust hole 102 are further formed on the outer surface of the cylinder head 1. The intake hole 101 communicates with the intake passage 103, and the exhaust hole 102 communicates with the exhaust passage.

As shown in FIGS. 9-12, the piston 3 has a spherical top surface, two side faces which form an angle and a piston pin boss at the lower part of the two side faces. The spherical top surface of the piston and the spherical inner cavity formed by the cylinder body 2 and the cylinder head 1 have the same center and form a sealed loose fit. The piston pin boss is a semi-cylinder, and a piston pin hole 302 which penetrates is provided on the central axis of the semi-cylinder. The piston pin boss at the lower part of the piston 3 is provided with an opening so as to form a fan-shaped cavity on the piston pin boss of the piston 3. The opening of the piston 3 is located in the middle of the piston pin boss and perpendicular to the axis of the piston pin hole 302 of the piston pin boss, and the width of the opening of the piston 3 is matched with the width of the semi-cylinder of the turntable pin boss. The turntable 5 has a turntable pin boss corresponding to the piston pin boss, and the turntable pin boss is arranged at the upper part of turntable 5. The outer peripheral surface between the upper part and the lower end face of the turntable 5 is a turntable spherical surface. The turntable spherical surface and the spherical inner cavity have the same center and are closely attached to each other to form a sealed loose fit. The two ends of the turntable pin boss are provided with semi-cylindrical grooves, the middle part of the turntable pin boss is provided with a protruding semi-cylinder, and a turntable pin hole 502 which penetrates is formed in the center of the semi-cylinder. A turntable shaft 501 matched with the turntable shaft hole 201 on the cylinder body 2 is fixedly provided at the center of the lower end of the turntable 5, and a piston shaft 301 is fixedly provided at the center of the spherical top surface of the piston 3. The turntable shaft 501 is inserted into the turntable shaft hole 201 on the cylinder body 2 to form a rotating pair with the cylinder body 2. The center pin 4 is inserted into a pin hole formed by matching the turntable pin boss with the piston pin boss to form a cylindrical hinge, and the matching surfaces of the cylindrical hinge form a sealed loose fit. The piston 3 and the turntable 5 form a sealed loose connection through the cylindrical hinge, and the two ends of the cylindrical hinge and the spherical inner cavity form a sealed loose fit.

Figure 9:
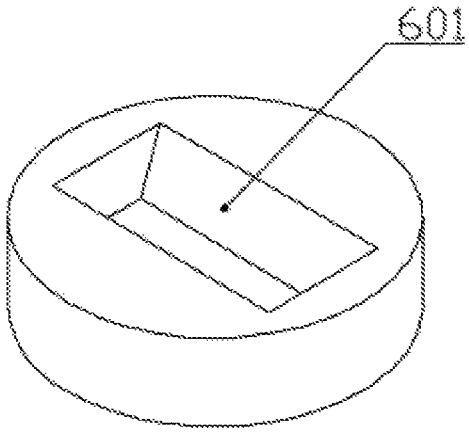
FIG. 9 is a schematic diagram of a rotary sleeve.
Figure 10:
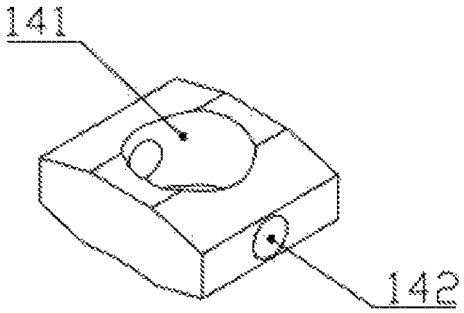
FIG. 10 is a schematic diagram of a piston shoe.
Figure 11:
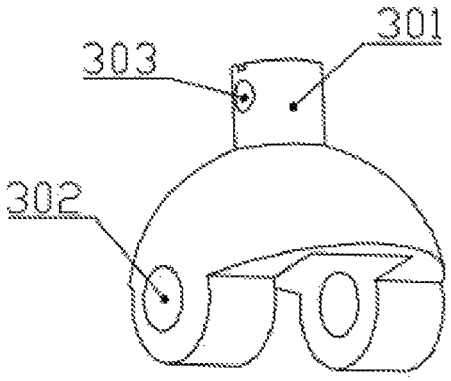
FIG. 11 is a schematic diagram of a piston of the first embodiment of the present invention.
Figure 12:
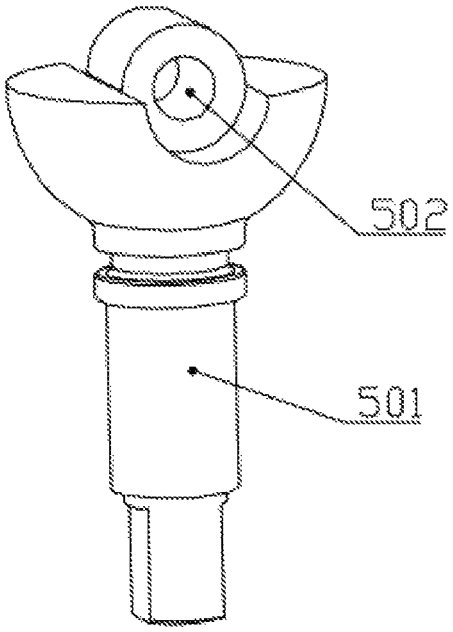
FIG. 12 is a schematic diagram of a turntable of the first embodiment of the present invention.

The piston shaft hole 105 on the cylinder head 1 communicates with the spherical inner cavity of the cylinder head 1 through a via hole, and the radial dimension of the via hole is smaller than the diameter of the piston shaft hole 105. An annular positioning surface is formed at the lower end of the piston shaft hole 105. The piston shaft hole 105 on the cylinder head 1 is provided with a rotary sleeve 6 in a cylindrical shape which is placed in the piston shaft hole 105. The end face of the rotary sleeve 6 is attached to the annular positioning surface. The outer cylinder of the rotary sleeve 6 is coaxial with the piston shaft hole 105. The rotary sleeve 6 can rotate around the axis of the piston shaft hole 105. As shown in FIG. 9, a rotary sleeve sliding chute 601 which can slide in the direction of the axis of the center pin 4 is arranged on the end face of the rotary sleeve 6. The two side faces of the rotary sleeve sliding chute 601 serve as sliding working surfaces and are symmetrically arranged on both sides of a plane of the axis of the center pin 4 and the axis of the piston shaft hole 105 in the cylinder head 1. A piston shoe shaft hole 141 is provided at the center of the piston shoe 14. As shown in FIG. 10, the two side faces of the piston shoe 14 are parallel planes. A piston shaft pin hole 303 is provided at the end of the piston shaft 301, and a piston shoe pin hole 142 is formed in the corresponding position of the piston shoe 14. After the piston shaft 301 passes through the via hole through which the piston shaft hole 301 communicates with the spherical inner cavity, the end of the piston shaft 301 is inserted into the piston shoe shaft hole 141. A fixing pin 10 is inserted into a fixing pin hole formed by the piston shaft pin hole 303 and the piston shoe pin hole 142, and the piston shoe 14 is fixed to the end of the piston shaft 301 by the fixing pin 10. The two side faces of the piston shoe 14 are attached to the two side faces of the rotary sleeve sliding chute 601 respectively, and a loose fit is formed along the two side faces of the rotary sleeve sliding chute 601 in a sliding manner. The two side faces of the piston shoe 14 are parallel to the plane of the axis of the piston shaft hole 105 and the axis of the center pin 4. The rotary sleeve sliding chute 601 on the rotary sleeve 6 and the piston shoe 14 on the piston shaft 301 form a sliding chute swinging mechanism 16. The turntable shaft 501 is inserted into the turntable shaft hole 201 in the cylinder body 2 to form a rotating pair with the cylinder body 2. The turntable shaft 501 is driven to rotate so that the turntable 5 drives the piston 3 to move through the cylindrical hinge. The movement of the piston 3 is rotation around the axis of the piston shaft hole 105 and swings around the center pin 4 relative to the turntable 5. Meanwhile, the piston 3 swings along the two side faces of the rotary sleeve sliding chute 601 on the rotary sleeve 6 through the piston shoe 14 at the end of the piston shaft 301 relative to the axis of the piston shaft hole 301 on the cylinder head 1 with a swing amplitude of $2\alpha$. The length of the two side faces of the rotary sleeve sliding chute 601 in the direction of the axis of the center pin 4 should be long enough to ensure that the swing of the piston shoe 14 is not interfered. In this embodiment, the sliding chute swinging mechanism 16 is used to provide the piston 3 with a degree of freedom to swing along the two side faces of the rotary sleeve sliding chute 601.

The piston 3 swings around the axis of the center pin 4 relative to the turntable 5, and a V1 working chamber 1001 and a V2 working chamber 1002 with alternatively variable volumes are formed between the upper end face of the turntable 5, the two side faces of the piston 3 and the spherical inner cavity. The intake passage 103 and the exhaust passage 104 on the cylinder head 1 are arranged in an annular space perpendicular to the axis of the piston shaft hole 105, and the intake passage 103 and the exhaust passage 104 communicate with an intake hole 101 and an exhaust hole 102 in the cylinder head 1 respectively. The intake hole 101 and the exhaust hole 102 communicate with the outside of the cylinder body 2. The air intake and discharge control is realized by the rotation of the piston 3, and when the working chambers need to discharge air or introduce air, the corresponding working chamber communicates with the intake passage 103 or the exhaust passage 104.

Figure 2:
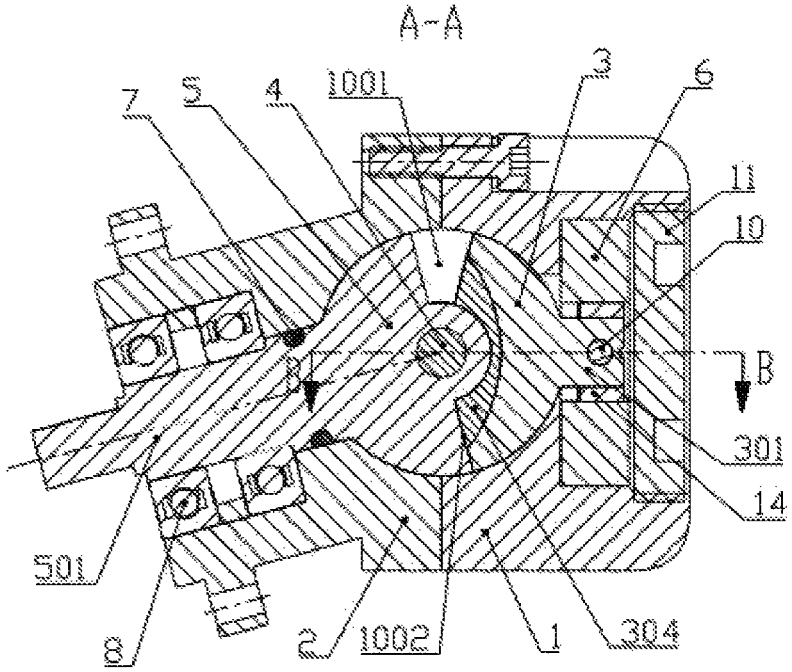
FIG. 2 is a cross-sectional view taken along an A-A line in FIG. 1.
Figure 3:
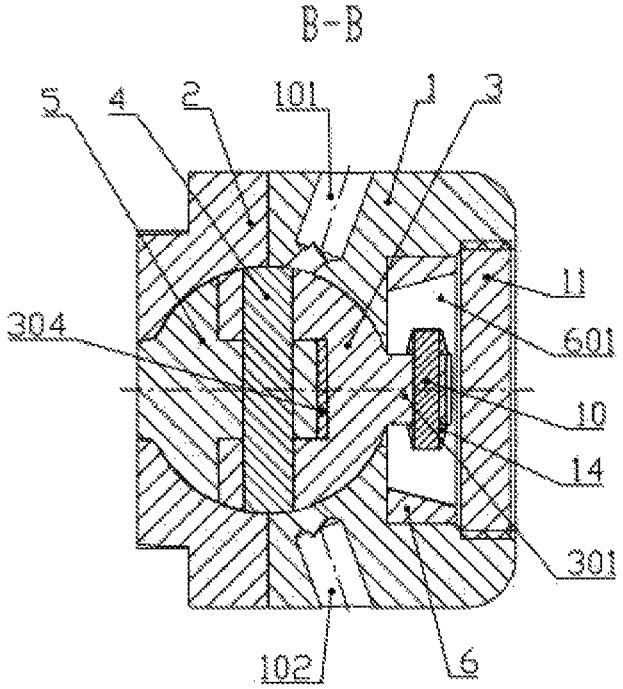
FIG. 3 is a cross-sectional view taken along a B-B line in FIG. 2.
Figure 4:
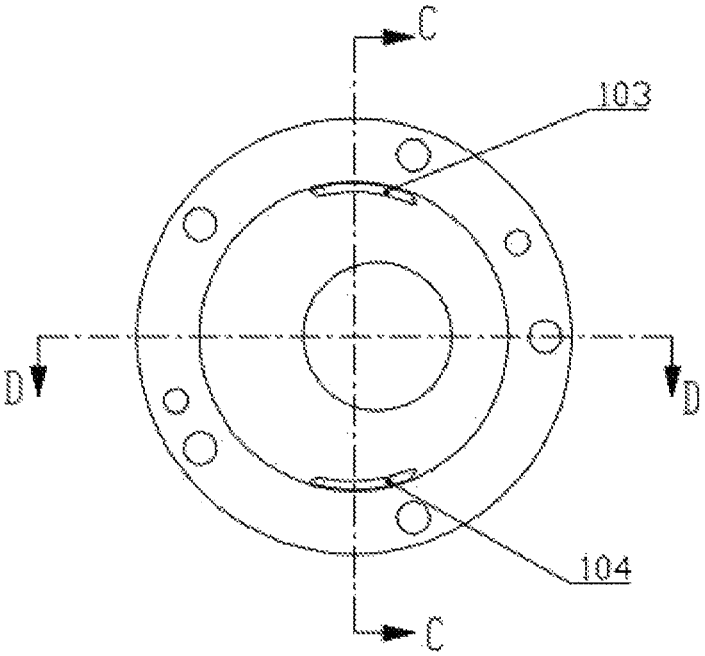
FIG. 4 is a schematic diagram of a cylinder head of the first embodiment of the present invention.
Figure 5:
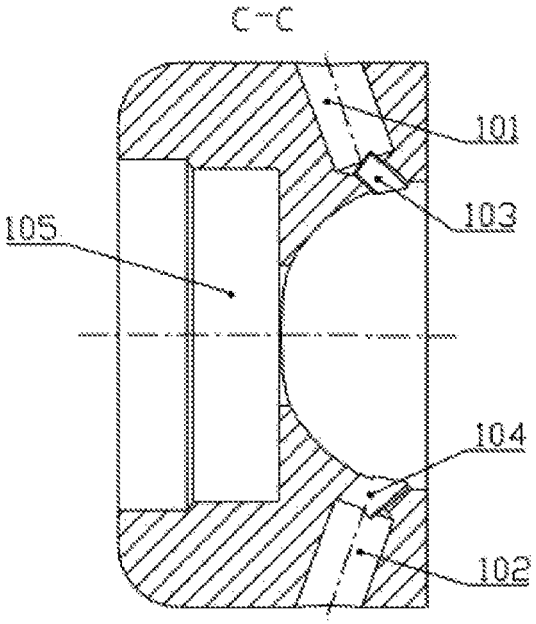
FIG. 5 is a cross-sectional view taken along a C-C line in FIG. 4.
Figure 6:
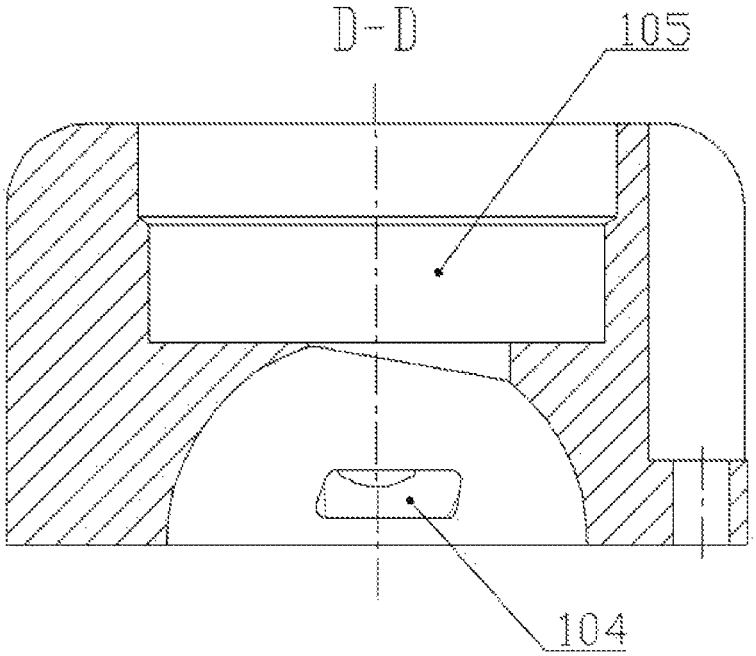
FIG. 6 is a cross-sectional view taken along a D-D line in FIG. 4.
Figure 7:
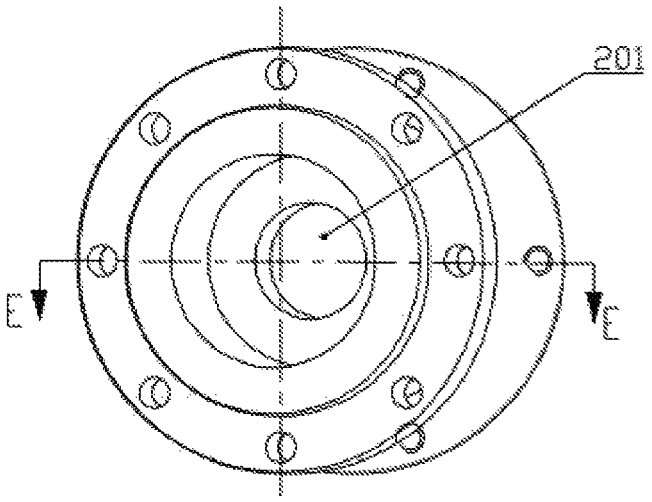
FIG. 7 is a schematic diagram of a cylinder body of the first embodiment of the present invention.
Figure 8:
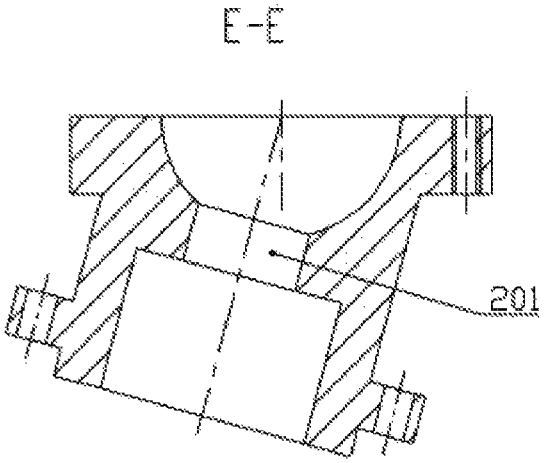
FIG. 8 is a cross-sectional view taken along an E-E line in FIG. 7.

As shown in FIG. 3, in this embodiment, the turntable shaft 501 extends out of the cylinder body 2 and is connected to a power mechanism to serve as a power input end of the compressor. A sealing ring 7 is arranged on the inner side of the portion, engaged with the turntable shaft hole 201 on the cylinder body 2, of the turntable shaft 501, and a bearing 8 is arranged at the end of the engagement portion. The power mechanism drives the turntable shaft 501 to rotate, and the volumes of the V1 working chamber 1001 and the V2 working chamber 1002 change constantly and alternately. In FIG. 2, the V1 working chamber 1001 and the V2 working chamber 1002 are in the ultimate state. The V1 working chamber 1001 is in a state that the air intake of the spherical compressor has completed, so the theoretical volume of the V1 working chamber 1001 in the figure is maximum, and the V2 working chamber 1002 is in a state of starting the air intake of the next cycle after discharging the air, so the theoretical volume of the V2 working chamber 1002 in the figure is zero. Each time the turntable shaft 501 drives the turntable 5 to rotate by one cycle, the piston 3 rotates around the axis of the piston shaft hole 105 by one cycle, and at the same time, the piston 3 swings once along the two side faces of the rotary sleeve sliding chute 601 relative to the axis of the piston shaft hole 105 on the cylinder head 1 at a swing angle of $2\alpha$. Since the piston 3 swings once around the axis of the center pin 4 relative to the turntable 5, the V1 working chamber 1001 and the V2 working chamber 1002 undergo a complete intake or compression exhaust process, respectively.

A sealing plug 11 is provided at the end of the piston shaft hole 105 on the cylinder head 1, and an internal thread is provided on the inner hole in the outer end of the piston shaft hole 105. The sealing plug 11 is provided with an external thread matched with the internal thread, and the sealing plug 11 is arranged at the end of the piston shaft hole 105 by the threads in a blocking mode, so that compression media and lubricating oil cannot leak from the piston shaft hole 105.

Figure 13:
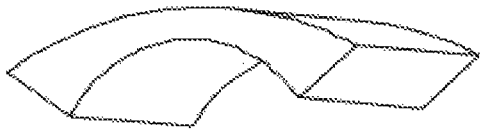
FIG. 13 is a schematic diagram of a piston insert.

In order to improve the manufacturability of the piston 3, as shown in FIG. 13, a piston insert 304 is arranged at the fan-shaped cavity at the opening of the piston 3. The piston insert 304 is matched with the opening of the piston 3 in size, and the top surface of the piston insert 304 is matched with the top surface of the opening of the piston 3. The two side faces of the piston insert 304 are matched with the two side faces of the piston 3. The two end faces of the piston insert 304 are matched with the two side faces of the opening of the piston 3. The lower end of the piston insert 304 is an arc of the same radius and coaxial with the piston pin hole 302 in the lower end of the piston 3. By making the top surface and the two end faces of the piston insert 304 and the top surface and the two side faces of the opening of the piston 3 into mutually matched planes, machining is convenient, and the machining precision and the matching precision after assembly are improved.

Inspired by this embodiment, those skilled in the art can perform the following deformation treatment on the turntable 5 and the cylinder body 2 without creative labor, and can also achieve the technical effect of the present invention: since the movement of the turntable 5 is rotation around the axis of the turntable shaft hole 201 on the cylinder body 2, the turntable spherical surface can be deformed into various forms of rotating surfaces around the axis of the turntable shaft hole 201 on the cylinder body 2, and the rotating surface can be spherical, cylindrical, conical and other forms. The inner spherical surface of the cylinder body 2 is also deformed into a rotating surface matched with the rotating surface of the turntable 5. The end faces of the two ends of the cylindrical hinge formed by the piston pin boss, the center pin 4 and the turntable pin boss and the inner surface of the cylinder body 2 are attached to each other and form a sealed loose fit during the movement of the piston 3 and the turntable 4. For this reason, the above-mentioned deformation scheme of the turntable and the cylinder body is also protected by this patent, and any technical scheme adopting the above deformation treatment also falls within the scope of the present application.

Example 2

FIGS. 14-23 show the illustration of the second embodiment. A center pin 4, a piston insert 304 and a piston shoe 14 in this embodiment are the structurally same as those in the first embodiment described above. As shown in FIGS. 14-16 and 20-23, a spherical compressor in this embodiment includes a cylinder head 1, a cylinder body 2, a piston 3, a center pin 4 and a turntable 5. The cylinder body 2 and the cylinder head 1 have hemispherical inner cavities, and the cylinder body 2 and the cylinder head 1 are fixedly connected by screws to form a casing of the spherical compressor with a spherical inner cavity. An intake passage 103, an exhaust passage 104 and a piston shaft hole 105 are provided on the inner spherical surface of the cylinder head 1. The cylinder body 2 is provided with a turntable shaft hole 201 in communication with the outside of the cylinder body. The turntable shaft hole 201 in the cylinder body 2 communicates with the spherical inner cavity of the cylinder body 2 through a via hole, and the radial dimension of the via hole is smaller than the diameter of the turntable shaft hole 201. An annular positioning surface is formed at the upper end of the turntable shaft hole 201. The axis of the piston shaft hole 105 and the axis of the turntable shaft hole 201 both pass through the center of the spherical inner cavity, and the included angle between the axis of the piston shaft hole 105 and the axis of the turntable shaft hole 201 is $\alpha$. The intake passage 103 and the exhaust passage 104 on the cylinder head 1 are arranged in an annular space perpendicular to the axis of the piston shaft hole 105 on the inner spherical surface, and an intake hole 101 and an exhaust hole 102 are further formed in the outer surface of the cylinder head 1. The intake hole 101 communicates with the intake passage 103, and the exhaust hole 102 communicates with the exhaust passage.

Figure 17:
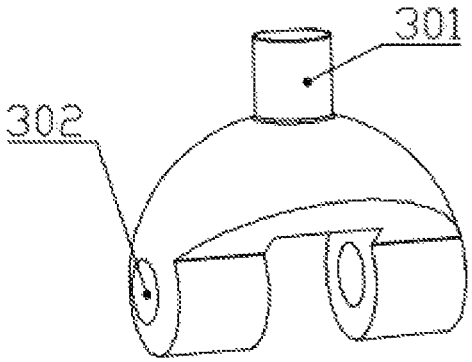
FIG. 17 is a schematic diagram of a piston of the second embodiment of the present invention.
Figure 18:
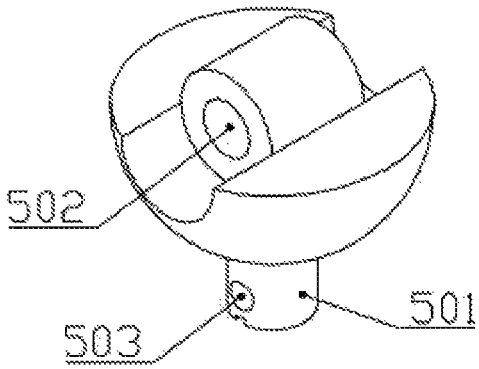
FIG. 18 is a schematic diagram of a turntable of the second embodiment of the present invention.
Figure 19:
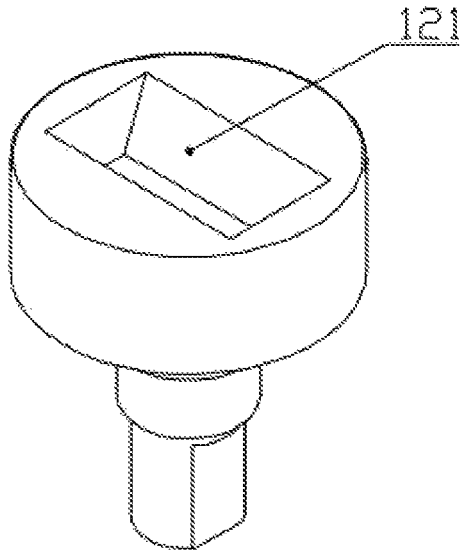
FIG. 19 is a schematic diagram of a main shaft of the second embodiment of the present invention.
Figure 20:
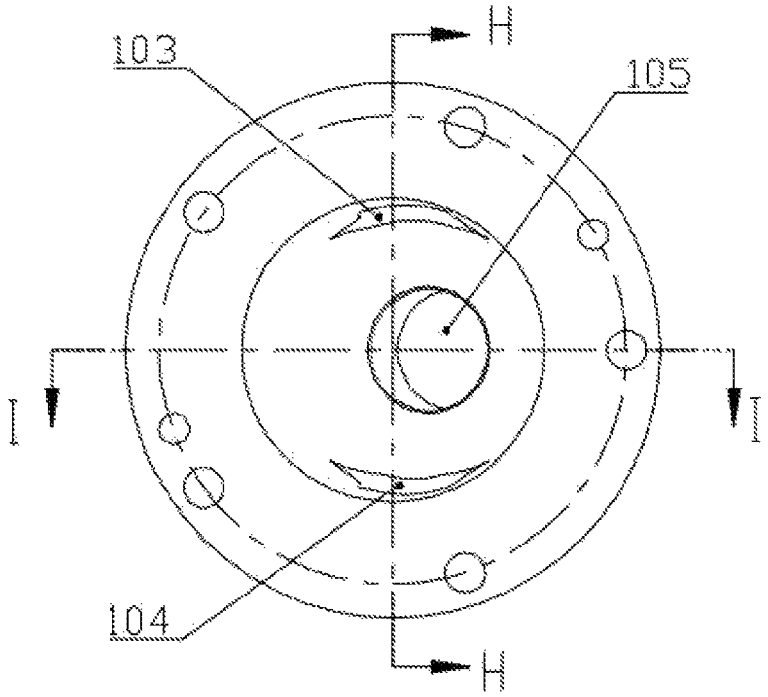
FIG. 20 is a schematic diagram of a cylinder head of the second embodiment of the present invention.
Figure 21:
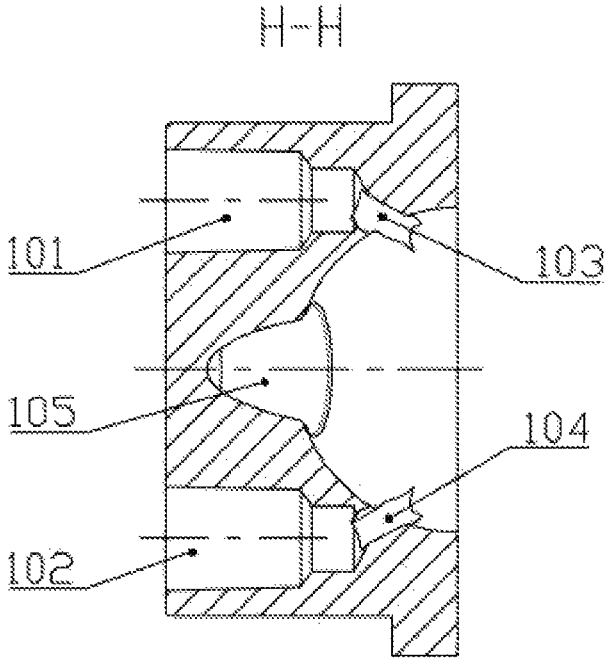
FIG. 21 is a cross-sectional view taken along an H-H line in FIG. 20.
Figure 22:
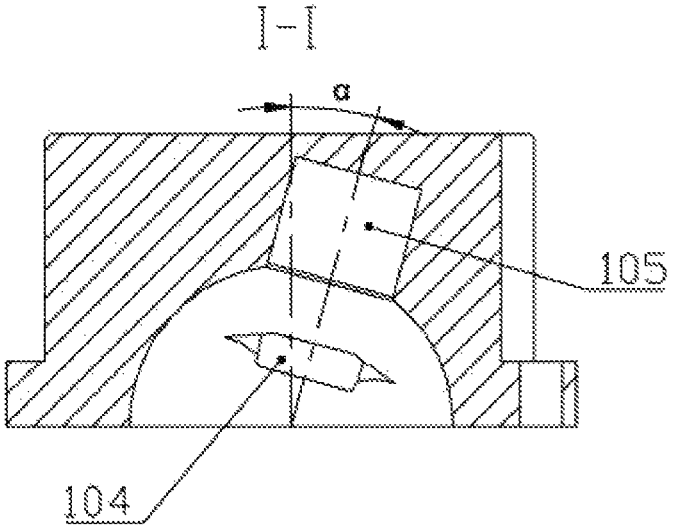
FIG. 22 is a cross-sectional view taken along an I-I line in FIG. 20.
Figure 23:
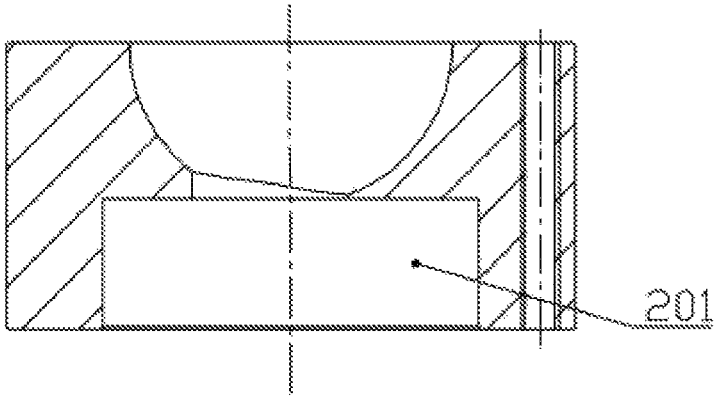
FIG. 23 is a schematic diagram of a cylinder body of the second embodiment of the present invention.

As shown in FIGS. 17-19, the piston 3 has a spherical top surface, two side faces which form an angle and a piston pin boss at the lower part of the two side faces. The spherical top surface of the piston and the spherical inner cavity formed by the cylinder body 2 and the cylinder head 1 have the same center and form a sealed loose fit. The piston pin boss is a semi-cylinder, and a piston pin hole 302 which penetrates is provided on the central axis of the semi-cylinder. The piston pin boss at the lower part of the piston 3 is provided with an opening so as to form a fan-shaped cavity on the piston pin boss of the piston 3, the opening of the piston 3 is located in the middle of the piston pin boss and perpendicular to the axis of the piston pin hole 302 of the piston pin boss, and the width of the opening of the piston 3 is matched with the width of the semi-cylinder of the turntable pin boss. The turntable 5 has a turntable pin boss corresponding to the piston pin boss, and the turntable pin boss is arranged at the upper part of the turntable 5. The outer peripheral surface between the upper part and the lower end face of the turntable 5 is a turntable spherical surface, and the turntable spherical surface and the spherical inner cavity have the same center and are closely attached to each other to form a sealed loose fit. The two ends of the turntable pin boss are provided with semi-cylindrical grooves, and the middle part of the turntable pin boss is provided with a protruding semi-cylinder. A turntable pin hole 502 which penetrates is formed in the center of the semi-cylinder. A turntable shaft 501 is provided at the lower end of the turntable 5, and a turntable shaft pin hole 503 is formed in the turntable shaft 501. A piston shaft 301 matched with the piston shaft hole 105 in the cylinder head 1 protrudes from the center of the spherical top surface of the piston 3, and the piston shaft 301 is inserted into the piston shaft hole 105 in the cylinder head 1 to form a rotating pair with the cylinder head 1. The center pin 4 is inserted into a pin hole formed by matching the turntable pin boss with the piston pin boss to form a cylindrical hinge, and the matching surfaces of the cylindrical hinge form a sealed loose fit. The piston 3 and the turntable 5 form a sealed loose connection through the cylindrical hinge, and the two ends of the cylindrical hinge and the spherical inner cavity form a sealed loose fit.

The lower end of the cylinder body 2 is connected to a main shaft 12 through a main shaft support 13, and the main shaft support 13 is fixedly connected to the lower end of the cylinder body 2 through screws to provide support for the rotation of the main shaft 12. The upper end of the main shaft 12 is placed in the turntable shaft hole 201. The outer cylinder at the upper end of the main shaft 12 is coaxial with the turntable shaft hole 201, and the main shaft 12 can rotate around the turntable shaft hole 201. A main shaft sliding chute 121 is provided on the upper end face of the main shaft 12 in the direction of the axis of the center pin 4, and the two side faces of the main shaft sliding chute 121 serve as sliding working surfaces and are symmetrically arranged on both sides of a plane of the axis of the turntable shaft hole 201 in the cylinder body 2 and the axis of the center pin 4. Similar to the structure of the piston shoe 14 in the first embodiment, a piston shoe shaft hole 141 is provided at the center of the piston shoe 14. As shown in FIGS. 10, 15, 16 and 18, the two side faces of the piston shoe 14 are parallel planes. A turntable shaft pin hole 503 is provided at the end of the turntable shaft 501, and a piston shoe pin hole 142 is formed in the corresponding position of the piston shoe 14. After the turntable shaft 501 passes through the via hole through which the turntable shaft hole 201 communicates with the spherical inner cavity, the end of the turntable shaft 501 is inserted into the piston shoe shaft hole 141. A fixing pin 10 is inserted into a fixing pin hole formed by the turntable shaft pin hole 503 and the piston shoe pin hole 142, and the piston shoe 14 is fixed to the end of the turntable shaft 501 by the fixing pin 10. The piston shoe 14 is arranged in the main shaft sliding chute 121 in the end of the main shaft 12, and the two side faces of the piston shoe 14 are attached to the two side faces of the main shaft sliding chute 121 and slide along the two side faces of the main shaft sliding chute 121 to form a loose fit, and the main shaft sliding chute 121 on the main shaft 12 and the piston shoe 14 on the turntable shaft 501 form a sliding chute swinging mechanism 16.

The lower end of the main shaft 12 extends out of a shaft hole of the main shaft support 13 and is connected to a power mechanism. The main shaft 12 drives the turntable shaft 501 to rotate through the two side faces of the main shaft sliding chute 121. The turntable 5 drives the piston 3 to move through the cylindrical hinge. The movement of the piston 3 is rotation around the axis of the piston shaft hole 105. The movement of the turntable 5 is rotation around the axis of the turntable shaft hole 201 and swings around the center pin 4 relative to the piston 3. Meanwhile, the turntable 5 swings along the two side faces of the main shaft sliding chute 121 through the piston shoe 14 relative to the axis of the turntable shaft hole 201 in the cylinder body 2 at a swing angle of $2\alpha$. The length of the two side faces of the main shaft sliding chute 121 in the direction of the axis of the center pin 4 should be long enough to ensure that the swing of the piston shoe 14 is not interfered. In this embodiment, the sliding chute swinging mechanism 16 is used to provide the turntable 5 with a degree of freedom to swing along the two side faces of the main shaft sliding chute 121.

The turntable 5 swings around the center pin 4 relative to the piston 3, and a V1 working chamber 1001 and a V2 working chamber 1002 with alternatively variable volumes are formed between the upper end face of the turntable 5, the two side faces of the piston 3 and the spherical inner cavity. The intake passage 103 and the exhaust passage 104 on the cylinder head 1 are arranged in an annular space perpendicular to the axis of the piston shaft hole 105. The intake passage 103 and the exhaust passage 104 communicate with an intake hole 101 and an exhaust hole 102 in the cylinder head 1 respectively, and the intake hole 101 and the exhaust hole 102 communicate with the outside of the cylinder body 2. The air intake and discharge control is realized by the rotation of the piston 3, and when the working chambers need to perform air discharge or air intake, the corresponding working chamber communicates with the intake passage 103 or the exhaust passage 104.

Figure 15:
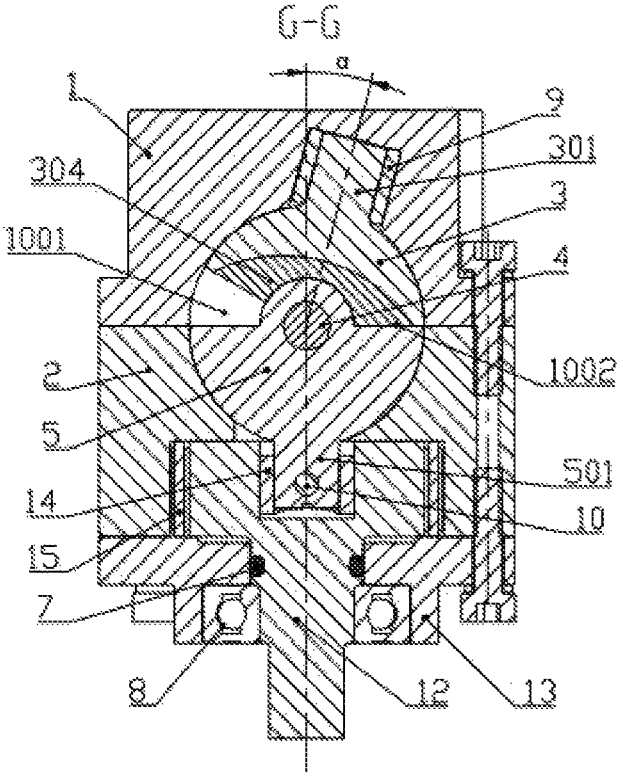
FIG. 15 is a cross-sectional view taken along a G-G line in FIG. 14.
Figure 16:
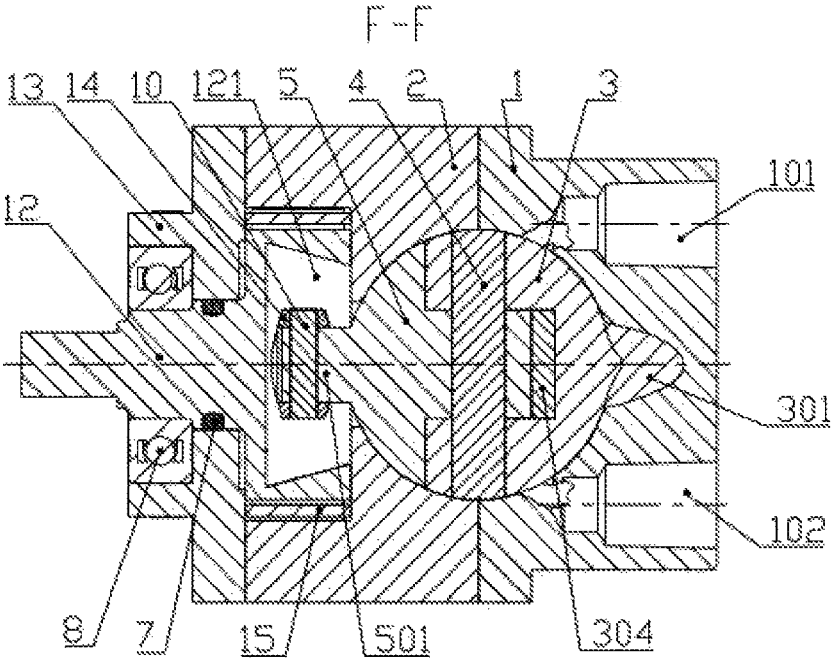
FIG. 16 is a cross-sectional view taken along an F-F line in FIG. 14.

The power mechanism drives the main shaft 12 to rotate, and the main shaft 12 drives the turntable shaft 501 to rotate through the two side faces of the main shaft sliding chute 121. The volumes of the V1 working chamber 1001 and the V2 working chamber 1002 change constantly. In FIG. 15, the V1 working chamber 1001 and the V2 working chamber 1002 are in the ultimate state. The V1 working chamber 1001 is in a state that the air intake of the spherical compressor has completed, so the theoretical volume of the V1 working chamber 1001 in the figure is maximum, and the V2 working chamber 1002 is in a state of starting the air intake of the next cycle after discharging the air, so the theoretical volume of the V2 working chamber 1002 in the figure is zero. Each time the turntable shaft 501 drives the turntable 5 to rotate by one cycle, the piston 3 rotates around the axis of the piston shaft hole 105 by one cycle, and at the same time, the turntable 5 swings once along the two side faces of the main shaft sliding chute 121 relative to the axis of the turntable shaft hole 201 in the cylinder body 2 at a swing angle of $2\alpha$. Since the turntable 5 swings once around the axis of the center pin 4 relative to the piston 3, the V1 working chamber 1001 and the V2 working chamber 1002 undergo a complete intake or compression exhaust process, respectively.

A needle bearing is arranged on the portion, matched with the turntable shaft hole 201 on the cylinder body 2, of the upper cylindrical part of the main shaft 12. A sealing ring 7 is arranged on the inner side of the portion, engaged with the main shaft support 13, of the main shaft 12, and a bearing 8 is arranged at the end of the engagement portion. A piston shaft sleeve 9 is arranged on the portion, matched with the piston shaft hole 105 on the cylinder head 1, of the piston shaft 301.

As an application extension of this embodiment, the piston shaft hole 105 on the cylinder head 1 communicates with the outside of the cylinder body, and the piston shaft 301 extends out of the piston shaft hole 105 on the cylinder head 1 and is connected to a power mechanism to serve as the power input end of the compressor, or power may be input from the piston shaft.

Figure 14:
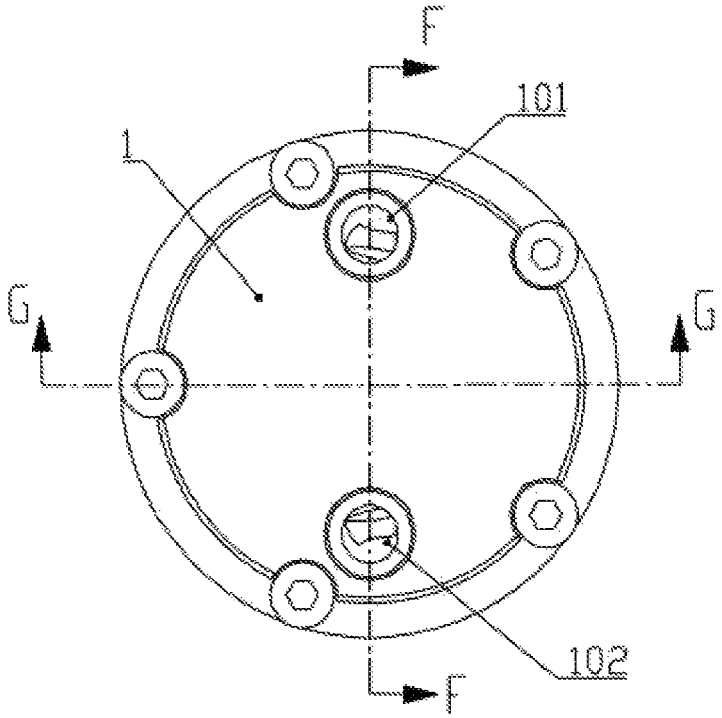
FIG. 14 is a schematic diagram of a second embodiment of the present invention.

In order to improve the manufacturability of the piston 3, as shown in FIG. 14, a piston insert 304 is arranged at the fan-shaped cavity at the opening of the piston 3. The piston insert 304 is matched with the opening of the piston 3 in size, and the top surface of the piston insert 304 is matched with the top surface of the opening of the piston 3. The two side faces of the piston insert 304 are matched with the two side faces of the piston 3. The two end faces of the piston insert 304 are matched with the two side faces of the opening of the piston 3. The lower end of the piston insert 304 is an arc of the same radius and coaxial with the piston pin hole 302 in the lower end of the piston 3. By making the top surface and the two end faces of the piston insert 304 and the top surface and the two side faces of the opening of the piston 3 into mutually matched planes, machining is convenient, and the machining precision and the matching precision after assembly are improved.

Inspired by this embodiment, those skilled in the art can perform the following deformation treatment on the piston 3 and the cylinder head 1 without creative labor, and can also achieve the technical effect of the present invention: since the movement of the piston 3 is rotation around the axis of the piston shaft hole 105 on the cylinder head 1, the spherical top surface of the piston 3 can be deformed into various forms of rotating surfaces around the axis of the piston shaft hole 105 on the cylinder head 1, and the rotating surface can be spherical, cylindrical, conical and other forms. The inner spherical surface of the cylinder head 1 is also deformed into a rotating surface matched with the rotating surface of the piston 3. The end faces of the two ends of the cylindrical hinge formed by the piston pin boss, the center pin 4 and the turntable pin boss and the inner spherical surface of the cylinder head 1 are attached to each other and form a sealed loose fit during the movement of the piston 3 and the turntable 4. For this reason, the above-mentioned deformation scheme of the piston 3 and the cylinder head 1 is also protected by this patent, and any technical scheme adopting the above-mentioned deformation treatment also falls within the scope of protection of the present invention.

According to the invention, the sliding chute swinging mechanism 16 is arranged between the piston shaft 301 and the piston shaft hole 105 or between the turntable shaft 501 and the turntable shaft hole 201. In the first embodiment, the sliding chute swinging mechanism 16 between the piston shaft 301 and the piston shaft hole 105 allows the piston 3 to swing along the two side faces of the rotary sleeve sliding chute 601 relative to the axis of the piston shaft hole 105, so that the piston 3 obtains a degree of freedom in the direction of the axis of the center pin 4. In the second embodiment, the sliding chute swinging mechanism 16 between the turntable shaft 501 and the turntable shaft hole 201 allows the turntable 5 to swing along the two side faces of the main shaft sliding chute 121 relative to the axis of the turntable shaft hole 201, so that the turntable 5 obtains a degree of freedom in the direction of the axis of the center pin 4.

What is claimed is:

1. A spherical compressor, comprising:

a cylinder body having a hemispherical inner cavity and a turntable shaft hole in communication with an outside of the cylinder body;

a cylinder head having a hemispherical inner cavity; wherein the cylinder head is combined with the cylinder body to form a spherical inner cavity; an intake passage, an exhaust passage and a piston shaft hole are provided on an inner spherical surface of the cylinder head; the intake passage and the exhaust passage on the cylinder head are respectively arranged in an annular space perpendicular to an axis of the piston shaft hole; the intake passage and the exhaust passage communicate with an intake hole and an exhaust hole on the cylinder head in communication with the outside of the cylinder body, respectively;

a piston having a spherical top surface, two side faces which form an angle, and a piston pin boss at a lower part of the two side faces; wherein the spherical top surface of the piston and the spherical inner cavity have the same center and form a sealed loose fit; the piston pin boss is a semi-cylinder; a groove is provided on a middle part of the semi-cylinder; a piston pin hole which penetrates is provided on a central axis of the semi-cylinder; a piston shaft protrudes from a center of the spherical top surface of the piston; and an axis of the piston shaft passes through the center of the spherical top surface of the piston;

a turntable having a turntable pin boss at an upper part of the turntable corresponding to the piston pin boss; wherein an outer peripheral surface between the upper part and a lower end face of the turntable is a turntable spherical surface; the turntable spherical surface has the same center with the spherical inner cavity and is closely attached to the spherical inner cavity to form a sealed loose fit; two ends of the turntable pin boss are provided with semi-cylindrical grooves; a middle part of the turntable pin boss is provided with a protruding semi-cylinder; a turntable pin hole which penetrates is formed in a central axis of the protruding semi-cylinder; a turntable shaft protrudes from a center of a lower end of the turntable; and the turntable shaft passes through the center of the turntable spherical surface; and a center pin inserted into a pin hole formed by matching the turntable pin boss with the piston pin boss to form a cylindrical hinge; wherein matching surfaces of the cylindrical hinge form a sealed loose fit;

wherein the axis of the piston shaft hole and the axis of the turntable shaft hole both pass through the center of the spherical inner cavity; and an included angle between the axis of the piston shaft hole and the axis of the turntable shaft hole is $\alpha$; a sliding chute swinging mechanism is arranged between the piston shaft and the piston shaft hole; and the sliding chute swinging mechanism between the piston shaft and the piston shaft hole allows the piston to swing along a sliding chute relative to the axis of the piston shaft hole; the turntable shaft is driven to rotate so that the piston swings relative to the turntable around an axis of the center pin; and a V1 working chamber and a V2 working chamber with alternatively variable volumes are formed between an upper end face of the turntable, the two side faces of the piston and the spherical inner cavity; and wherein a rotary sleeve in a cylindrical shape is arranged in the piston shaft hole in the cylinder head; an outer cylinder of the rotary sleeve is coaxial with the piston shaft hole; the rotary sleeve rotates around the axis of the piston shaft hole; a rotary sleeve sliding chute in a direction of an axis of the center pin is arranged on an end face of the rotary sleeve; and two side faces of the rotary sleeve sliding chute are symmetrically arranged on both sides of a plane of the axis of the center pin and the axis of the piston shaft hole; a piston shoe is fixedly arranged at an end of the piston shaft; the piston shoe is arranged in the rotary sleeve sliding chute; two side faces of the piston shoe are attached to the two side faces of the rotary sleeve sliding chute and slide along the two side faces of the rotary sleeve sliding chute to form a loose fit; and the rotary sleeve sliding chute on the rotary sleeve and the piston shoe on the piston shaft form the sliding chute swinging mechanism; the turntable shaft is inserted into the turntable shaft hole on the cylinder body to form a rotating pair with the cylinder body; and a sealing plug is arranged at an end of the piston shaft hole on the cylinder head.

2. The spherical compressor of claim 1, wherein a piston shaft pin hole is provided at the end of the piston shaft; a piston shoe shaft hole and a piston shoe pin hole matched with the piston shaft pin hole are provided at a center of the piston shoe; and the piston shaft is inserted into the piston shoe shaft hole after passing through a via hole through which the piston shaft hole communicates with the spherical inner cavity; and a fixing pin is inserted into a pin hole formed by matching the piston shoe pin hole with the piston shaft pin hole to fix the piston shoe at the end of the piston shaft; the two side faces of the piston shoe are parallel planes; and the two side faces of the piston shoe are respectively attached to the two side faces of the rotary sleeve sliding chute to form a loose fit.

3. The spherical compressor of claim 2, wherein the turntable shaft extends out of the cylinder body and is connected to a power mechanism.

4. The spherical compressor of claim 2, wherein the piston comprises a piston insert; the piston insert is of a fan-shaped block structure and is embedded in the groove in the middle part of the piston pin boss of the piston; and the shape of an inner cylindrical surface of the piston insert is matched with the shape of a protruding semi-cylindrical surface of the turntable to form a sealed loose fit; and a protruding top surface of the piston insert is an outer cylindrical surface which is matched with a bottom surface of the groove of the piston pin boss of the piston; two side faces of the piston insert are flush with the two side faces of the piston; and two end faces of the piston insert form a sealed loose fit with two side walls of the groove in the middle part of the piston pin boss.

5. The spherical compressor of claim 1, wherein the piston comprises a piston insert; the piston insert is of a fan-shaped block structure and is embedded in the groove in the middle part of the piston pin boss of the piston; and the shape of an inner cylindrical surface of the piston insert is matched with the shape of a protruding semi-cylindrical surface of the turntable to form a sealed loose fit; and a protruding top surface of the piston insert is an outer cylindrical surface which is matched with a bottom surface of the groove of the piston pin boss of the piston; two side faces of the piston insert are flush with the two side faces of the piston; and two end faces of the piston insert form a sealed loose fit with two side walls of the groove in the middle part of the piston pin boss.

6. A spherical compressor, comprising:

a cylinder body having a hemispherical inner cavity and a turntable shaft hole in communication with an outside of the cylinder body;

a cylinder head having a hemispherical inner cavity; wherein the cylinder head is combined with the cylinder body to form a spherical inner cavity; an intake passage, an exhaust passage and a piston shaft hole are provided on the inner spherical surface of the cylinder head; the intake passage and the exhaust passage on the cylinder head are respectively arranged in an annular space perpendicular to an axis of the piston shaft hole; the intake passage and the exhaust passage communicate with an intake hole and an exhaust hole on the cylinder head in communication with the outside of the cylinder body, respectively;

a piston comprising a spherical top surface, two side faces which form an angle, and a piston pin boss at the lower part of the two side faces; wherein the spherical top surface of the piston and the spherical inner cavity have the same center and form a sealed loose fit; the piston pin boss is a semi-cylinder; a middle part of the semi-cylinder is provided with a groove; a central axis of the semi-cylinder is provided with a piston pin hole penetrates; a piston shaft protrudes from a center of the spherical top surface of the piston; and an axis of the piston shaft passes through the center of the spherical top surface of the piston;

a turntable having a turntable pin boss at an upper part of the turntable corresponding to the piston pin boss; wherein an outer peripheral surface between the upper part and a lower end face of the turntable is a turntable spherical surface; the turntable spherical surface has the same center with the spherical inner cavity and is closely attached to the spherical inner cavity to form a sealed loose fit; two ends of the turntable pin boss are provided with semi-cylindrical grooves; a middle part of the turntable pin boss is provided with a protruding semi-cylinder; a turntable pin hole which penetrates is formed in a central axis of the protruding semi-cylinder; a turntable shaft protrudes from a center of the lower end of the turntable; and the turntable shaft passes through the center of the turntable spherical surface;

a center pin inserted into a pin hole formed by matching the turntable pin boss with the piston pin boss to form a cylindrical hinge; wherein matching surfaces of the cylindrical hinge form a sealed loose fit;

wherein the axis of the piston shaft hole and the axis of the turntable shaft hole both pass through the center of the spherical inner cavity; and an included angle between the axis of the piston shaft hole and the axis of the turntable shaft hole is $\alpha$; a sliding chute swinging mechanism is arranged between the turntable shaft and the turntable shaft hole; and the sliding chute swinging mechanism between the turntable shaft and the turntable shaft hole allows the turntable to swing along a sliding chute relative to the axis of the turntable shaft hole at an angle of $2\alpha$; the turntable shaft is driven to rotate so that the turntable swings relative to the piston around the center pin; and a V1 working chamber and a V2 working chamber with alternatively variable volumes are formed between an upper end face of the turntable, the two side faces of the piston and the spherical inner cavity; and wherein a lower end of the cylinder body is connected to a main shaft through a main shaft support; an upper end of the main shaft is placed in the turntable shaft hole; an outer cylinder at the upper end of the main shaft is coaxial with the turntable shaft hole; and the main shaft rotates around the turntable shaft hole; a main shaft sliding chute is provided on an upper end face of the main shaft in a direction of an axis of the center pin; and two side faces of the main shaft sliding chute are symmetrically arranged on both sides of a plane of the axis of the turntable shaft hole and the axis of the center pin; a piston shoe is fixedly arranged at an end of the turntable shaft; the piston shoe is arranged in the main shaft sliding chute; two side faces of the piston shoe are attached to the two side faces of the main shaft sliding chute and slide along the two side faces of the main shaft sliding chute to form a loose fit; and the main shaft sliding chute on the main shaft and the piston shoe at the end of the turntable shaft form the sliding chute swinging mechanism.

7. The spherical compressor of claim 6, wherein a lower end of the main shaft is connected to a power mechanism.

8. The spherical compressor of claim 6, wherein a turntable shaft pin hole is provided at the end of the turntable shaft; a piston shoe shaft hole and a piston shoe pin hole matched with the turntable shaft pin hole are provided at a center of the piston shoe; and the turntable shaft is inserted into the piston shoe shaft hole after passing through a via hole through which the turntable shaft hole communicates with the spherical inner cavity; and a fixing pin is inserted into a pin hole formed by matching the piston shoe pin hole with the turntable shaft pin hole to fix the piston shoe at the end of the turntable shaft; the two side faces of the piston shoe are parallel planes; and the two side faces of the piston shoe are attached to the two side faces of the main shaft sliding chute respectively to form a loose fit.

9. The spherical compressor of claim 8, wherein the piston shaft hole on the cylinder head is in communication with the outside of the cylinder body; and the piston shaft protrudes from the piston shaft hole and is connected to a power mechanism.

10. The spherical compressor of claim 8, wherein the piston comprises a piston insert; the piston insert is of a fan-shaped block structure and is embedded in the groove in the middle part of the piston pin boss of the piston; and the shape of an inner cylindrical surface of the piston insert is matched with the shape of a protruding semi-cylindrical surface of the turntable to form a sealed loose fit; and a protruding top surface of the piston insert is an outer cylindrical surface which is matched with a bottom surface of the groove of the piston pin boss of the piston; the two side faces of the piston insert are flush with the two side faces of the piston; and the two end faces of the piston insert form a sealed loose fit with two side walls of the groove in the middle part of the piston pin boss.

11. The spherical compressor of claim 6, wherein the piston shaft hole on the cylinder head is in communication with the outside of the cylinder body; and the piston shaft protrudes from the piston shaft hole and is connected to a power mechanism.

12. The spherical compressor of claim 6, wherein the piston comprises a piston insert; the piston insert is of a fan-shaped block structure and is embedded in the groove in the middle part of the piston pin boss of the piston; and the shape of an inner cylindrical surface of the piston insert is matched with the shape of a protruding semi-cylindrical surface of the turntable to form a sealed loose fit; and a protruding top surface of the piston insert is an outer cylindrical surface which is matched with a bottom surface of the groove of the piston pin boss of the piston; the two side faces of the piston insert are flush with the two side faces of the piston; and two end faces of the piston insert form a sealed loose fit with two side walls of the groove in the middle part of the piston pin boss.

* * * * *